US008552919B2

(12) United States Patent
Hsieh et al.

(10) Patent No.: US 8,552,919 B2
(45) Date of Patent: Oct. 8, 2013

(54) ANTENNA MODULE

(75) Inventors: Shih-Wei Hsieh, Taipei (TW); Shyh-Tirng Fang, Tai-Nan (TW)

(73) Assignee: Mediatek Inc., Hsin-Chu (TW)

( * ) Notice: Subject to any disclaimer, the term of this patent is extended or adjusted under 35 U.S.C. 154(b) by 306 days.

(21) Appl. No.: 13/069,643

(22) Filed: Mar. 23, 2011

(65) Prior Publication Data

US 2012/0242555 A1 Sep. 27, 2012

(51) Int. Cl.
*H01Q 19/00* (2006.01)

(52) U.S. Cl.
USPC ..... 343/833; 343/722

(58) Field of Classification Search
USPC ..... 343/747, 833, 834, 722, 767, 702, 343/700 MS
See application file for complete search history.

(56) References Cited

U.S. PATENT DOCUMENTS

| | | | | |
|---|---|---|---|---|
| 7,265,720 | B1 * | 9/2007 | De Leon et al. | 343/700 MS |
| 7,336,229 | B1 | 2/2008 | Tseng et al. | |
| 7,701,401 | B2 | 4/2010 | Suzuki et al. | |
| 7,742,003 | B2 | 6/2010 | Tseng et al. | |
| 7,791,546 | B2 | 9/2010 | Hotta et al. | |
| 7,812,773 | B2 | 10/2010 | Qi et al. | |
| 2008/0180333 | A1 * | 7/2008 | Martiskainen et al. | 343/722 |
| 2008/0252533 | A1 | 10/2008 | Hung et al. | |
| 2008/0266185 | A1 | 10/2008 | Hung et al. | |
| 2009/0167627 | A1 | 7/2009 | Breiter | |
| 2009/0231200 | A1 | 9/2009 | Chiu et al. | |
| 2010/0214180 | A1 * | 8/2010 | Krogerus | 343/702 |
| 2011/0122027 | A1 * | 5/2011 | Wong et al. | 343/700 MS |
| 2011/0294537 | A1 * | 12/2011 | Vance | 455/550.1 |
| 2012/0262343 | A1 * | 10/2012 | Radojkovic | 343/702 |

FOREIGN PATENT DOCUMENTS

| | | |
|---|---|---|
| WO | WO 2010/146157 | 12/2010 |
| WO | WO 2011/024280 | 3/2011 |

OTHER PUBLICATIONS

English language translation of abstract of WO 2011/024280 (published Mar. 3, 2011).

* cited by examiner

*Primary Examiner* — Thien M Le
(74) *Attorney, Agent, or Firm* — McClure, Qualey & Rodack, LLP

(57) ABSTRACT

An antenna module is provided. The antenna module includes a radiator, a feed pin, a ground element, a first parasitic arm, a second parasitic arm and an impedance matching unit. The radiator includes a first section and a second section, wherein an end of the first section is connected to the second section, and the first section is perpendicular to the second section. The feed pin is connected to another end of the first section. The first parasitic arm is parallel to the second section, wherein an end of first parasitic arm is connected to the ground element, and the first parasitic arm couples with the second section of the radiator. The impedance matching unit is connected to the second section and the ground element. The second parasitic arm is partially parallel to the first section, and the second parasitic arm couples with the first section of the radiator, and an end of the second parasitic arm is connected to the ground element.

19 Claims, 5 Drawing Sheets

ANTENNA MODULE

BACKGROUND OF THE INVENTION

1. Field of the Invention

The present invention relates to an antenna module, and in particular relates to a Penta-band antenna module.

2. Description of the Related Art

Nowadays, mobile devices require multi-mode and multi-band communication functions, and need to transmit wireless signals of frequency bands such as GSM850/900/1800/1900/UMTS (Penta-band), where GSM and UMTS are the abbreviations of Global System for Mobile Communications and the Universal Mobile Telecommunications System, respectively.

Conventionally, a dielectric antenna module is utilized to transmit wireless signals of frequency bands such as GSM850/900/1800/1900/UMTS (Penta-band). A conventional dielectric antenna module includes a Planar Inverted F Antenna (PIFA) radiator and a dielectric radiator. The PIFA radiator is utilized to transmit wireless signals of frequency bands such as GSM800/900, and the dielectric radiator is utilized to transmit wireless signals of frequency bands such as GSM1800/1900/2100. A conventional dielectric antenna module is expensive, causing the increased cost of a mobile device.

BRIEF SUMMARY OF THE INVENTION

An antenna module is provided. The antenna module includes a radiator, a feed pin, a ground element, a first parasitic arm, a second parasitic arm and an impedance matching unit. The radiator includes a first section and a second section, wherein an end of the first section is connected to the second section, and the first section is perpendicular to the second section. The feed pin is connected to another end of the first section. The first parasitic arm is parallel to the second section, wherein an end of first parasitic arm is connected to the ground element, and the first parasitic arm couples with the second section of the radiator. The impedance matching unit is connected to the second section and the ground element. The second parasitic arm is partially parallel to the first section, and the second parasitic arm couples with the first section of the radiator, and an end of the second parasitic arm is connected to the ground element.

In the embodiment of the invention, four ground points are utilized to improve impedance matching effect. The first parasitic arm couples with the second section of the radiator to increase wideband coverage of the antenna module to 850 GHz. The second parasitic arm couples with the first section of the radiator to increase wideband coverage of the antenna module to 1900 MHz and 2100 MHz. The length of the first parasitic arm is shorter than a quarter of the wavelength of the signal at 850 GHz. The impedance matching unit improves impedance matching effect, and increases bandwidth of the antenna module at high frequency bands (1900 MHz to 2100 MHz). The first parasitic arm, the second parasitic arm and impedance matching unit generate inductance and capacitance effect to offset reactance and to increase impedance bandwidth. The antenna module of the embodiment of the invention provides a Penta-band coverage (GSM850/900/1800/1900/UMTS). The antenna module of the embodiment of the invention is provided at a low cost (about USD 0.2), and with a wide bandwidth, good impedance matching and high efficiency.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
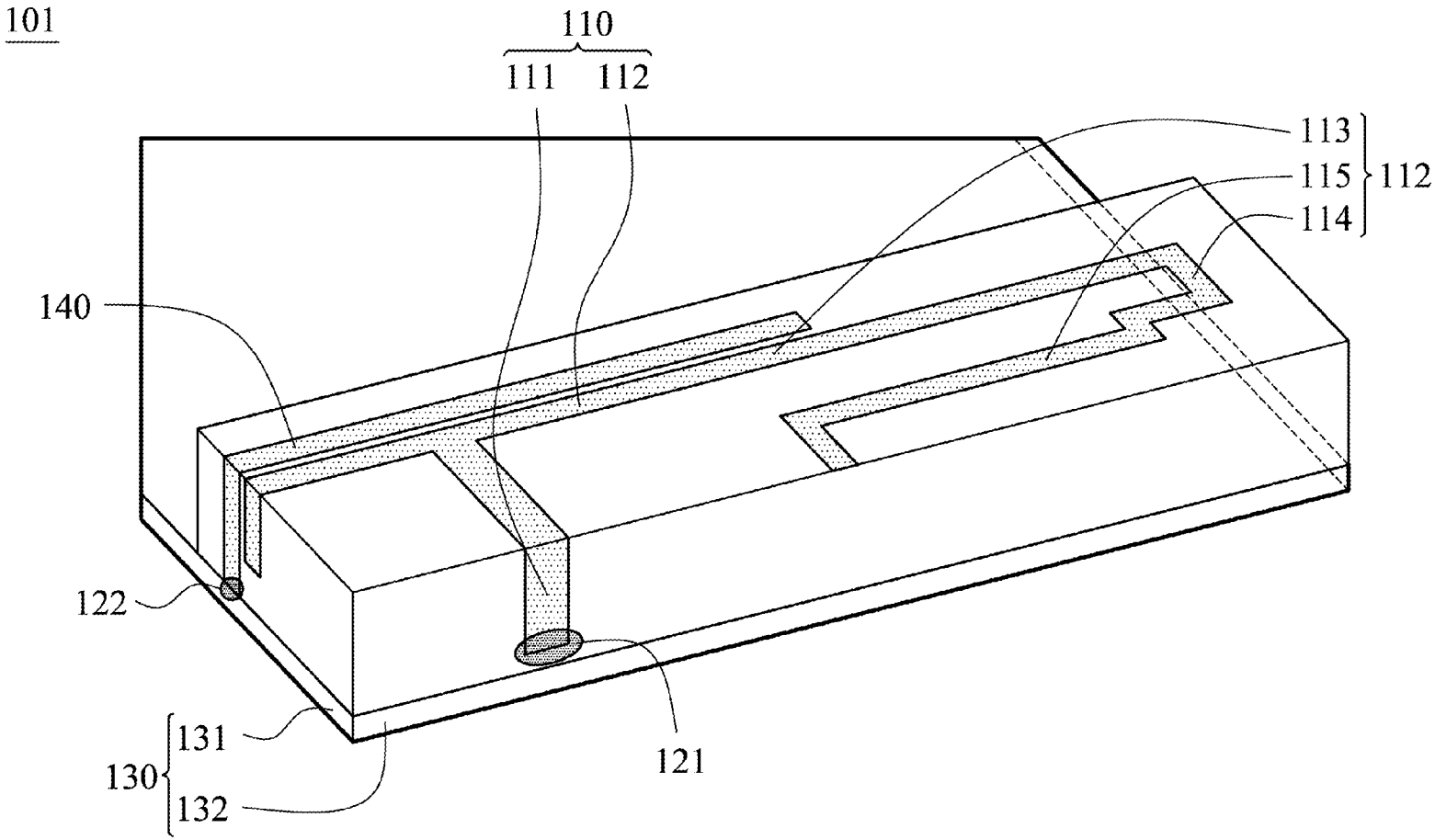
FIG. 1 shows an antenna module of a first embodiment of the invention.

FIG. 1 shows an antenna module 101 of a first embodiment of the invention. The antenna module 101 includes a radiator 110, a feed pin 121, a ground element 130 and a first parasitic arm 140. The radiator 110 comprises a first section 111 and a second section 112, wherein an end of the first section 111 is connected to the second section 112, and the first section 111 is perpendicular to the second section 112. The feed pin 121 is connected to another end of the first section 111. The first parasitic arm 140 is parallel and adjacent to at least portion of the second section 112, wherein an end of first parasitic arm 140 is connected to the ground element 130 at a ground point 122, and the first parasitic arm 140 couples with the second section 112 of the radiator 110.

In this embodiment, the ground element 130 is planar, and the ground element 130 comprises a first side 131 and a second side 132, and the first side 131 is perpendicular to the second side 132, and the first parasitic arm 140 is extended from the first side 131.

In this embodiment, the first parasitic arm 140 is longitudinal. At least portion of the second section 112 of the radiator 110 is located between the first section 111 of the radiator 110 and the first parasitic arm 140. In the first embodiment, the length of the second section 112 of the radiator 110 is about a quarter of the wavelength of the signal at, for example, 850 MHz. The first parasitic arm 140 couples with the second section 112 of the radiator 110 to increase wideband coverage of the antenna module to, for example, 850 MHz. The length of the first parasitic arm 140 is shorter than a quarter of the wavelength of the signal at, for example, 850 MHz.

Figure 2:
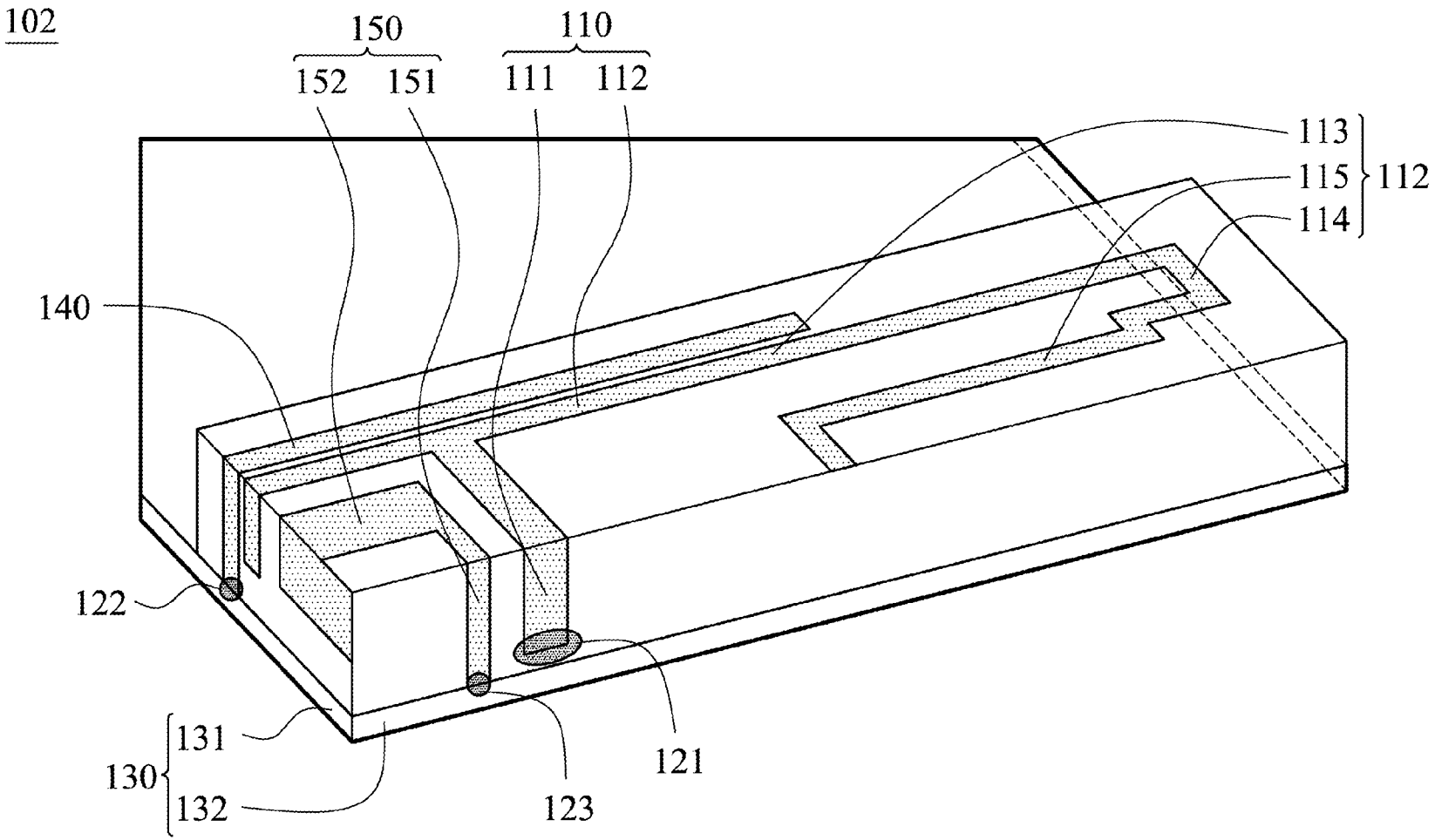
FIG. 2 shows an antenna module of a second embodiment of the invention.

FIG. 2 shows an antenna module 102 of a second embodiment of the invention. The antenna module 102 includes a radiator 110, a feed pin 121, a ground element 130, a first parasitic arm 140 and a second parasitic arm 150. The radiator 110 comprises a first section 111 and a second section 112, wherein an end of the first section 111 is connected to the second section 112. The feed pin 121 is connected to another end of the first section 111. The first parasitic arm 140 is parallel and adjacent to at least portion of the second section 112, wherein an end of first parasitic arm 140 is connected to the ground element 130 at a ground point 122, and the first parasitic arm 140 couples with the second section 112 of the radiator 121. The second parasitic arm 150 is partially parallel to the first section 111, and the second parasitic arm 150 couples with the first section 111 of the radiator 110, and an end of the second parasitic arm 150 is connected to the ground element 130 at another ground point 123.

In this embodiment, the ground element 130 is planar, and the ground element 130 comprises a first side 131 and a second side 132, and the first side 131 is perpendicular to the second side 132, and the first parasitic arm 140 is extended from the first side 131, and the second parasitic arm 150 is extended from the second side 132.

In this embodiment, the first parasitic arm 140 is longitudinal. The second parasitic arm 150 comprises a first parasitic section 151 and a second parasitic section 152, and the first parasitic section 151 is connected to the second parasitic section 152, an end of the first parasitic section 151 is connected to the ground element 130, and the first parasitic section 151 is parallel and adjacent to the first section 111 of the radiator 110, and the second parasitic section 152 is partially parallel to the second section 112 of the radiator 110. In this embodiment, the first parasitic section 151 is longitudinal, and the second parasitic section 152 is L shaped.

In this embodiment, at least portion of the second section 112 of the radiator 110 is located between the first section 111 of the radiator 110 and the first parasitic arm 140, and at least portion of the second section 112 of the radiator 110 is located between the first parasitic arm 140 and the second parasitic arm 150. The first parasitic arm 140 and the second parasitic arm 150 may be utilized separately. The location of the first parasitic arm 140 and the second parasitic arm 150 disclosed above does not restrict the invention.

In the second embodiment, the first parasitic arm 140 couples with the second section 112 of the radiator 110 to increase wideband coverage of the antenna module to, for example, 850 MHz (low band). The second parasitic arm 150 couples with the first section 111 of the radiator 110 to increase wideband coverage of the antenna module to, for example, 1900 MHz and 2100 MHz (high band). The length of the first parasitic arm 140 is shorter than a quarter of the wavelength of the signal at, for example, 850 MHz.

Figure 3:
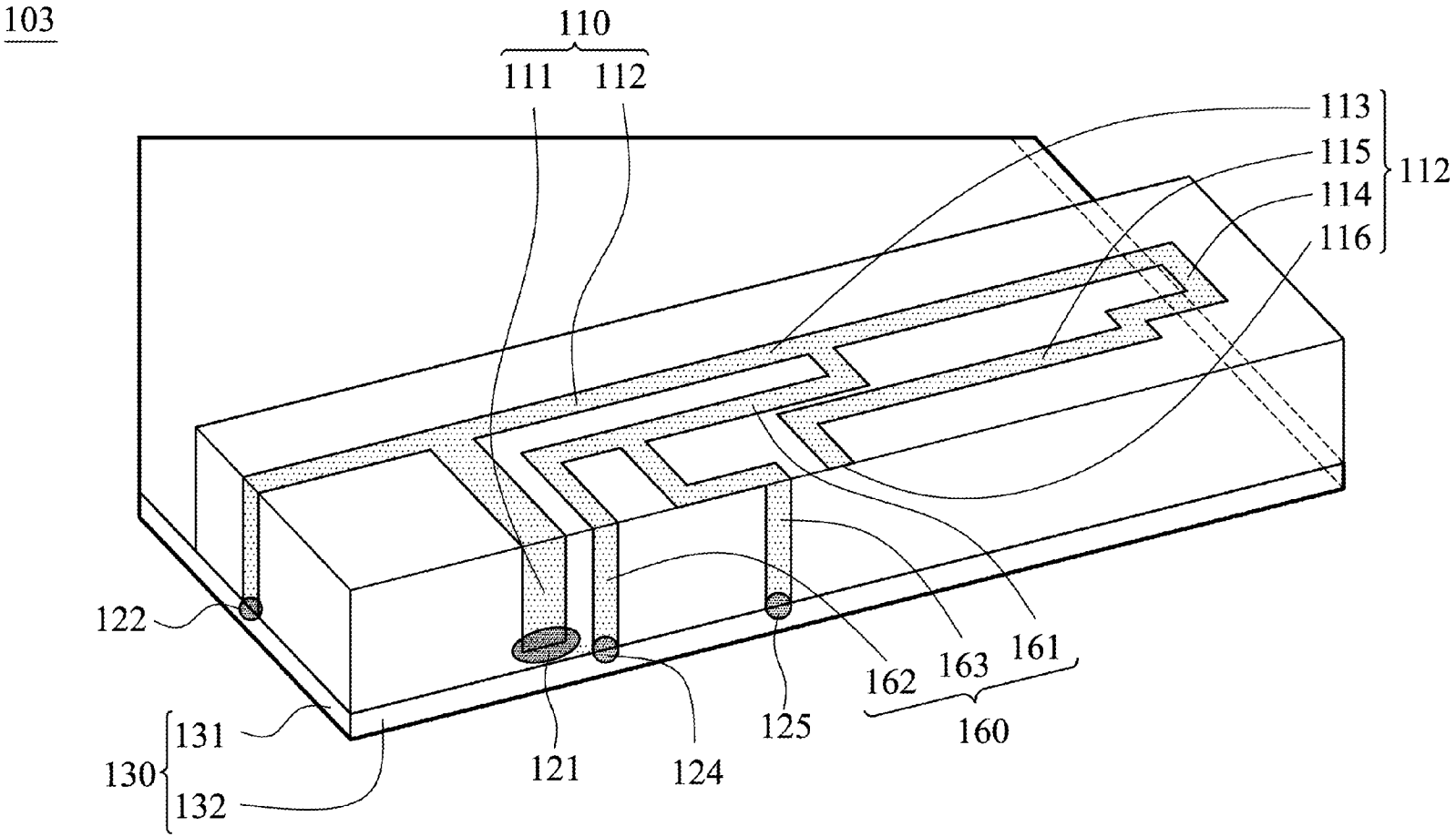
FIG. 3 shows an antenna module of a third embodiment of the invention.

FIG. 3 shows an antenna module 103 of a third embodiment of the invention. The antenna module 103 includes a radiator 110, a feed pin 121, a ground element 130, and an impedance matching unit 160. The radiator 110 comprises a first section 111 and a second section 112, wherein an end of the first section 111 is connected to the second section 112. The feed pin 121 is connected to another end of the first section 111. The impedance matching unit 160 is connected to the second section 112 and the ground element 130.

The impedance matching unit 160 comprises a first matching section 161, a second matching section 162 and a third matching section 163, and the first matching section 161 is connected to the second section 112 of the radiator 110, and the second matching section 162 is connected to the first matching section 161 and the ground element 130, and the third matching section 163 is connected to the first matching section 161 and the ground element 130. The second matching section 162 and the third matching section 163 are connected to the ground element 130 on ground points 124 and 125, respectively.

The first matching section 161 may be L shaped, and any of the second matching section 162 and the third matching section 163 may be longitudinal, L shaped, zigzag shaped or a similar but different shape.

More specifically, the second section 112 of the radiator comprises a first portion 113, a second portion 114 and a third portion 115, and the first portion 113 is connected to the first section 111, and the second portion 114 is connected and perpendicular to the first portion 113, and the third portion 115 is connected and perpendicular to the second portion 114, and the third portion 115 extends toward the third matching section 163. The third portion 115 couples with the third matching section 163. In this embodiment, the third portion 115 comprises a free end 116, and the free end couples with the third matching section 163.

In the third embodiment, the impedance matching unit 160 improves impedance matching effect, and increases bandwidth of the antenna module at high frequency bands (e.g. 1900 MHz to 2100 MHz).

Figure 4:
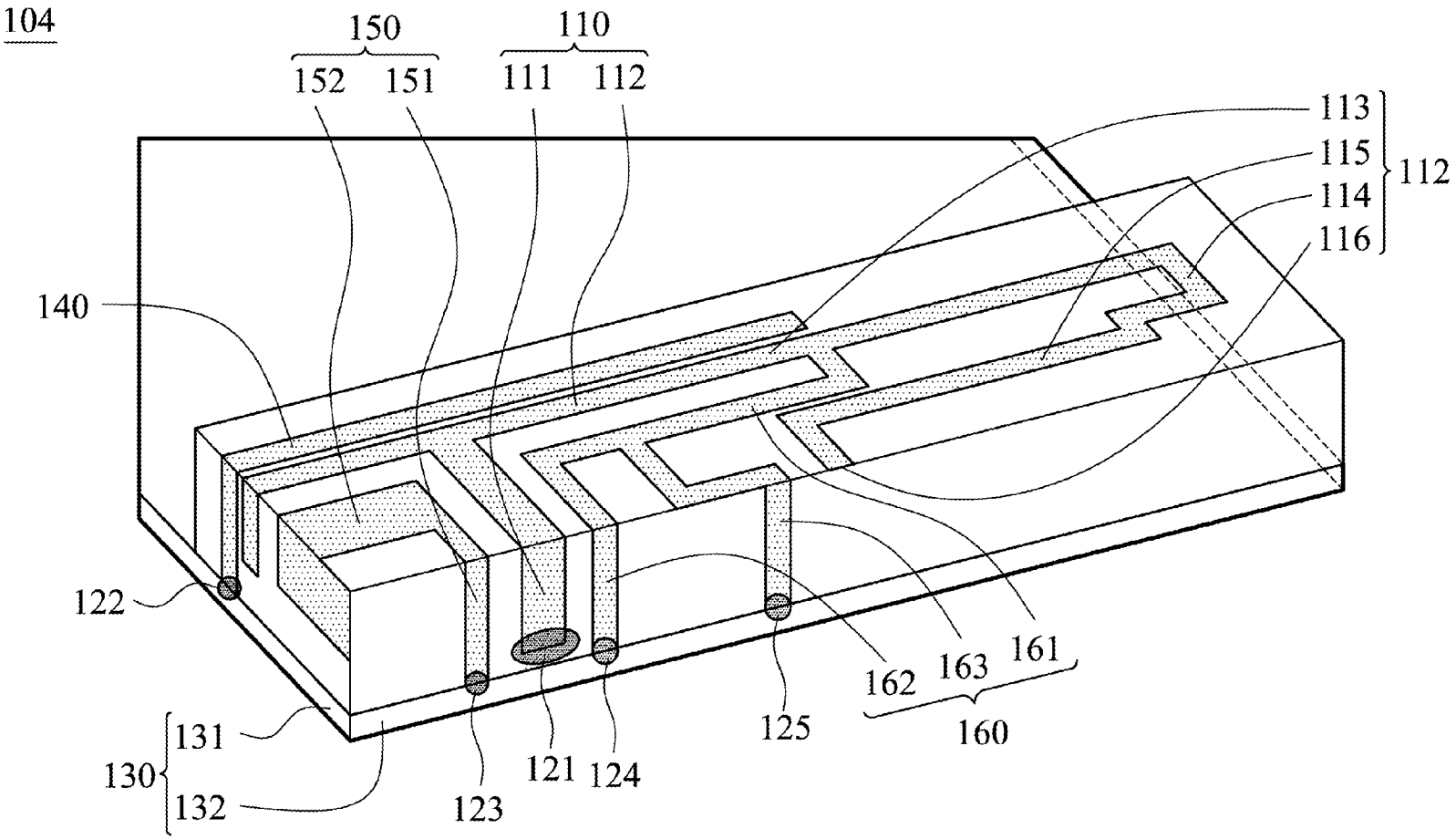
FIG. 4 shows an antenna module of a fourth embodiment of the invention.

FIG. 4 shows an antenna module 104 of a fourth embodiment of the invention. The antenna module 104 includes a radiator 110, a feed pin 121, a ground element 130, a first parasitic arm 140, a second parasitic arm 150 and an impedance matching unit 160. The radiator 110 comprises a first section 111 and a second section 112, wherein an end of the first section 111 is connected to the second section 112. The feed pin 121 is connected to another end of the first section 111. The first parasitic arm 140 is parallel and adjacent to at least portion of the second section 112, wherein an end of first parasitic arm 140 is connected to the ground element 130 at a ground point 122, and the first parasitic arm 140 couples with the second section 112 of the radiator 110. The second parasitic arm 150 is partially parallel to the first section 111, and the second parasitic arm 150 couples with the first section 111 of the radiator 110, and an end of the second parasitic arm 150 is connected to the ground element 130 at another ground point 123.

The impedance matching unit 160 comprises a first matching section 161, a second matching section 162 and a third matching section 163, and the first matching section 161 is connected to the second section 112 of the radiator 110, and the second matching section 162 is connected to the first matching section 161 and the ground element 130, and the third matching section 163 is connected to the first matching section 161 and the ground element 130. The second matching section 162 and the third matching section 163 are connected to the ground element 130 on ground points 124 and 125, respectively.

The second section 112 of the radiator comprises a first portion 113, a second portion 114 and a third portion 115, and the first portion 113 is connected to the first section 111, and the second portion 114 is connected and perpendicular to the first portion 113, and the third portion 115 is connected and perpendicular to the second portion 114, and the third portion 115 extends toward the third matching section 163. The third portion 115 couples with the third matching section 163. In this embodiment, the third portion 115 comprises a free end 116, and the free end couples with the third matching section 163.

In this embodiment, the ground element 130 is planar, and the ground element 130 comprises a first side 131 and a second side 132, and the first side 131 is perpendicular to the second side 132, and the first parasitic arm 140 is extended from the first side 131, and the second parasitic arm 150 is extended from the second side 132.

In this embodiment, the first parasitic arm 140 is longitudinal. The second parasitic arm 150 comprises a first parasitic section 151 and a second parasitic section 152, and the first parasitic section 151 is connected to the second parasitic section 152, an end of the first parasitic section 151 is connected to the ground element 130, and the first parasitic section 151 is parallel and adjacent to the first section 111 of the radiator 110, and the second parasitic section 152 is partially parallel to the second section 112 of the radiator 110. In this embodiment, the first parasitic section 151 is longitudinal, and the second parasitic section 152 is L shaped.

In this embodiment, at least portion of the second section 112 of the radiator 110 is located between the first section 111 of the radiator 110 and the first parasitic arm 140, and at least portion of the second section 112 of the radiator 110 is located between the first parasitic arm 140 and the second parasitic arm 150. The first parasitic arm 140 and the second parasitic arm 150 may be utilized separately. The location of the first parasitic arm 140 and the second parasitic arm 150 disclosed above does not restrict the invention.

Figure 5:
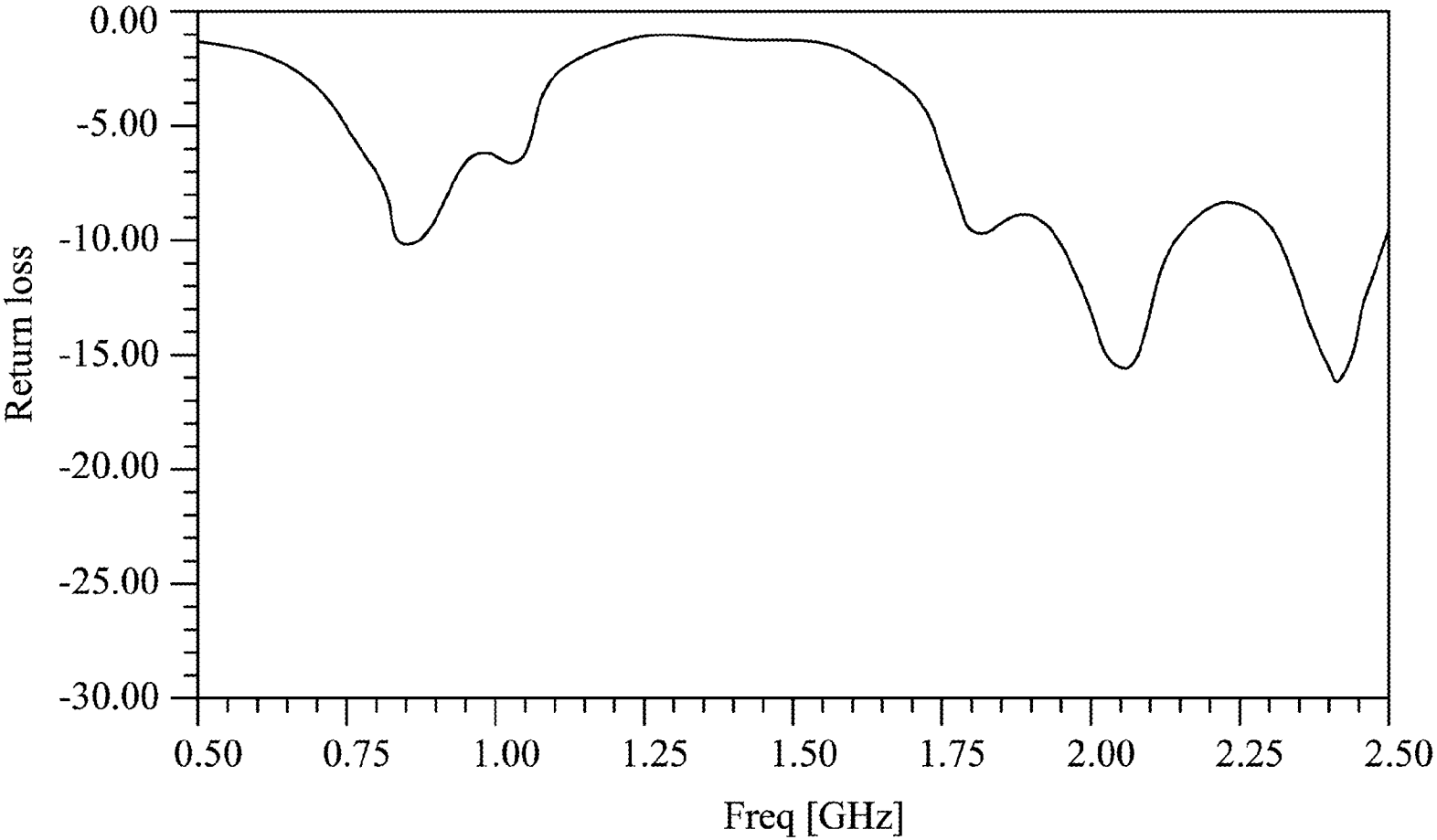
FIG. 5 shows bandwidth of the antenna module of a fourth embodiment.

In the fourth embodiment, four ground points 122 to 125 are utilized to improve impedance matching effect. The first parasitic arm 140 couples with the second section 112 of the radiator 110 to increase wideband coverage of the antenna module to, for example, 850 MHz. The second parasitic arm 150 couples with the first section 111 of the radiator 110 to increase wideband coverage of the antenna module to, for example, 1900 MHz and 2100 MHz. The length of the first parasitic arm 140 is shorter than a quarter of the wavelength of the signal at, for example, 850 MHz. The impedance matching unit 160 improves impedance matching effect, and increases bandwidth of the antenna module at high frequency bands (e.g. 1900 MHz to 2100 MHz). The first parasitic arm 140, the second parasitic arm 150 and impedance matching unit 160 generate inductance and capacitance effect to offset reactance and increase impedance bandwidth. FIG. 5 shows an exemplary diagram illustrating return loss magnitudes versus different frequencies generated by the antenna module 104 of a fourth embodiment. As shown in FIG. 5, the antenna module of the fourth embodiment provides a Penta-band coverage (GSM850/900/1800/1900/UMTS), where GSM and UMTS are the abbreviations of Global System for Mobile Communications and the Universal Mobile Telecommunications System, respectively. The antenna module of the embodiments of the invention may be provided in a lower cost than that of a Planar Inverted F Antenna (PIFA) radiator or a dielectric radiator. The antenna module of the embodiments of may further provide a wider bandwidth, a better impedance matching and/or a higher efficiency.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

a radiator, comprising a first section and a second section, wherein an end of the first section is connected to the second section, and the first section is perpendicular to the second section;

a feed pin, connected to another end of the first section;

a ground element;

a first parasitic arm, parallel to the second section, wherein an end of first parasitic arm is connected to the ground element, and the first parasitic arm couples with the second section of the radiator, and the first parasitic arm is shorter than the second section of the radiator; and an impedance matching unit, connected to the second section and the ground element.

2. The antenna module as claimed in claim 1, further comprising a second parasitic arm, wherein the second parasitic arm is partially parallel to the first section, and the second parasitic arm couples with the first section of the radiator, and an end of the second parasitic arm is connected to the ground element.

3. The antenna module as claimed in claim 2, wherein the ground element is planar, and the ground element comprises a first side and a second side, and the first side is perpendicular to the second side, and the first parasitic arm is extended from the first side, and the second parasitic arm is extended from the second side.

4. The antenna module as claimed in claim 2, wherein the second parasitic arm comprises a first parasitic section and a second parasitic section, and the first parasitic section is connected to the second parasitic section, an end of the first parasitic section is connected to the ground element, and the first parasitic section is parallel to the first section of the radiator, and the second parasitic section is partially parallel to the second section of the radiator.

5. The antenna module as claimed in claim 2, wherein at least portion of the second section is located between the first section and the first parasitic arm.

6. The antenna module as claimed in claim 2, wherein at least portion of the second section is located between the first parasitic arm and the second parasitic arm.

7. The antenna module as claimed in claim 1, wherein the impedance matching unit comprises a first matching section, a second matching section and a third matching section, and the first matching section is connected to the second section of the radiator, and the second matching section is connected to the first matching section and the ground element, and the third matching section is connected to the first matching section and the ground element.

8. The antenna module as claimed in claim 7, wherein the second section of the radiator comprises a first portion, a second portion and a third portion, and the first section is connected to the first portion, and the second portion is connected and perpendicular to the first portion, and the third portion is connected and perpendicular to the second portion, and the third portion extends toward the third matching section.

9. An antenna module, comprising:

a radiator, comprising a first section and a second section, wherein an end of the first section is connected to the second section;

a feed pin, connected to another end of the first section;

a ground element; and a first parasitic arm, parallel to the second section, wherein an end of first parasitic arm is connected to the ground element, and the first parasitic arm couples with the second section of the radiator, and the first parasitic arm is shorter than the second section of the radiator.

10. The antenna module as claimed in claim 9, further comprising a second parasitic arm, wherein the second parasitic arm is partially parallel to the first section, and the second parasitic arm couples with the first section of the radiator, and an end of the second parasitic arm is connected to the ground element.

11. The antenna module as claimed in claim 10, wherein the ground element is planar, and the ground element comprises a first side and a second side, and the first side is perpendicular to the second side, and the first parasitic arm is extended from the first side, and the second parasitic arm is extended from the second side.

12. The antenna module as claimed in claim 10, wherein the second parasitic arm comprises a first parasitic section and a second parasitic section, and the first parasitic section is connected to the second parasitic section, an end of the first parasitic section is connected to the ground element, and the first parasitic section is parallel to the first section of the radiator, and the second parasitic section is partially parallel to the second section of the radiator.

13. The antenna module as claimed in claim 12, wherein the first parasitic section is longitudinal, and the second parasitic section is L shaped.

14. The antenna module as claimed in claim 10, wherein at least portion of the second section is located between the first section and the first parasitic arm.

15. The antenna module as claimed in claim 10, wherein at least portion of the second section is located between the first parasitic arm and the second parasitic arm.

16. An antenna module, comprising:

a radiator, comprising a first section and a second section, wherein an end of the first section is connected to the second section;

a feed pin, connected to another end of the first section;

a ground element; and an impedance matching unit, connected to the second section and the ground element, wherein the impedance matching unit comprises a first matching section, a second matching section and a third matching section, and the first matching section is connected to the second section of the radiator, and the second matching section is connected to the first matching section and the ground element, and the third matching section is connected to the first matching section and the ground element.

17. The antenna module as claimed in claim 16, wherein the second section comprises a free end, and the free end couples with the third matching section.

18. The antenna module as claimed in claim 16, wherein the first matching section is L shaped, and the second matching section is longitudinal or zigzag shaped, and the third matching section is longitudinal or zigzag shaped.

19. The antenna module as claimed in claim 16, wherein the second section of the radiator comprises a first portion, a second portion and a third portion, and the first section is connected to the first portion, and the second portion is connected and perpendicular to the first portion, and the third portion is connected and perpendicular to the second portion, and the third portion extends toward the third matching section.

* * * * *